United States Patent [19]

Itoh et al.

[11] 4,119,685

[45] Oct. 10, 1978

[54] VARIABLE VENTURI TYPE CARBURETOR

[75] Inventors: Takaaki Itoh; Kazuo Kikuchi, both of Susono, Japan

[73] Assignee: Toyota Jidosha Kogyo Kabushiki Kaisha, Japan

[21] Appl. No.: 837,099

[22] Filed: Sep. 28, 1977

[30] Foreign Application Priority Data

Jun. 21, 1977 [JP] Japan ..... 52-72895

[51] Int. Cl.[2] ..... F02M 9/06

[52] U.S. Cl. ..... 261/44 C

[58] Field of Search ..... 261/44 C, 50 A

[56] References Cited

U.S. PATENT DOCUMENTS

| | | | |
|---|---|---|---|
| 1,996,245 | 4/1935 | Hunt | 261/39 B |
| 2,325,918 | 8/1943 | Perrine | 261/39 B |
| 3,227,428 | 1/1966 | Charron | 261/39 B |
| 3,669,424 | 6/1972 | Shiobara et al. | 261/44 C |

*Primary Examiner*—Tim R. Miles

*Attorney, Agent, or Firm*—Stevens, Davis, Miller & Mosher

[57] ABSTRACT

Disclosed is a variable venturi type carburetor comprising a movable suction piston which changes the cross-sectional area of a venturi portion of an intake passage in response to the amount of air flowing therethrough. The suction piston has a needle entering into a stationary jet. The needle and the jet define an annular opening through which the fuel is injected into the venturi portion. The jet is connected to a fuel reservoir via a fuel supply passage. On the bottom face of the suction piston and on the inner wall of the venturi portion, members for magnetically attracting each other are mounted, respectively.

4 Claims, 3 Drawing Figures

VARIABLE VENTURI TYPE CARBURETOR

BACKGROUND OF THE INVENTION

This invention relates to a carburetor of an internal combustion engine, and more particularly relates to a variable venturi type carburetor in which, during the no-load running operation or idle driving condition the atomization characteristic is improved and the change in the amount of fuel being fed to the engine combustion chambers is reduced.

A variable venturi type carburetor comprises a suction piston movably mounted on a venturi portion of an intake passage so as to vary the cross-sectional area thereof in accordance with the change in the amount of air being fed to the engine combustion chambers. As is well-known, the cross-sectional area of the venturi portion is controlled so that the velocity of air flowing in the venturi, that is, the vacuum level in the venturi, is always maintained at a constant value. A tapered needle fixed to the suction piston enters into a fuel injection jet communicated with a fuel float chamber so that an amount of fuel proportional to the amount of air flowing in the venturi is sucked into the intake passage.

From the practical point of view, however, the velocity of air flowing in the venturi, or the vacuum level therein is not completely constant at any time, but shows a tendency to increase when the amount of air flowing in the venturi increases. Therefore, if a variable venturi type carburetor is set so as to attain the most suitable velocity or vacuum level of air when the amount of suction air is maximum, a sufficient velocity or vacuum of air flowing in the venturi cannot be obtained when the amount of suction air is small, that is when the engine is in the no-load running operation or the idle driving condition. Thus, during the idle driving condition, very fine grained fuel cannot be injected from the fuel injection jet. That is, the atomization characteristic is lowered, because the velocity of air flowing in the venturi is lowered and a sufficient vacuum therein cannot be obtained. Furthermore, during the idle driving condition, the vacuum level in the venturi is greatly influenced by the vibration of the different parts of the carburetor, such as the venturi portion and the suction piston, caused by the vibration of whole engine, because the cross-sectional area of the venturi is small. That is to say, the velocity of air flowing in the venturi and the vacuum level therein are changed, so that the amount of suction air is also largely changed. Therefore, during the no-load running operation or idle driving condition, a sufficient uniform air-fuel mixture cannot be obtained. Especially, in a multi-cylinder type internal combustion engine, the fuel distribution into each cylinder cannot be performed uniformly, the fuel combustion in the engine cannot be stabilized and misfires may occur, so that smooth operation of the engine is disturbed. In addition, fuel consumption during the idle driving condition is not economical and noxious combustible substances, such as hydrocarbons (HC) or carbon monoxide (CO), are contained in the exhaust gas.

SUMMARY OF THE INVENTION

An object of this invention is to provide a variable venturi type carburetor of an internal combustion engine capable of overcoming the defects mentioned above.

Another object of this invention is to provide a variable venturi type carburetor of an internal combustion engine capable of increasing the velocity of suction air flowing in the venturi and the vacuum level therein during the no-load running operation or idle driving condition, improving the atomization characteristic of fuel fed into the cylinders of engine and improving the stability of the fuel combustion in the engine.

A further object of this invention is to provide a variable venturi type carburetor of an internal combustion engine capable of reducing the variation of the vacuum level in the venturi caused by the vibration of the engine during the idle driving condition, reducing the variation of the amount of suction air and the fuel consumption, and reducing noxious combustible substances, such as HC or CO contained in the exhaust gas.

According to the present invention, there is provided a variable venturi type carburetor, comprising: a housing; a bore extending through said housing and having an inner wall defining an intake passage; a suction piston movably mounted in said housing and having a bottom end face projecting into said intake passage, said bottom end face of said suction piston and said inner wall of said intake passage defining a venturi, said suction piston moving up and down so as to change the cross-sectional area of said venturi in response to a change in the vacuum produced in said intake passage downstream of said venturi for maintaining the velocity of air flowing into said venturi at a constant value; a jet disposed on the inner wall of said intake passage at a position facing said bottom end face of said suction piston; a needle fixed onto said bottom end face of said suction piston and entering into said jet, said jet and said needle defining an annular opening through which fuel is injected into said intake passage; a fuel reservoir in said housing; a fuel supply passage disposed in said housing and communicating said fuel reservoir with said jet; at least one first members made of magnetic material attached to the bottom end face of said suction piston, and; at least one second members made of magnetic material attached to said inner wall of said venturi at the positions corresponding to the positions of said at least one first members, said first and second members magnetically contacting each other when said suction piston is in the position in which the cross-sectional area of said venturi is minimum.

One of the first and second members may be permanent magnet and the other of said members may be made of metal magnetic material. Preferably, at least one of the first and second members are made of resilient material, or are attached to the bottom end face of the suction piston or the inner wall of the intake passage by thread engagements so that the minimum cross-sectional area of the venturi can be adjusted.

The present invention may be more fully understood from the description set forth below of preferred embodiments of the invention, together with the accompanying drawings.

DESCRIPTION OF PREFERRED EMBODIMENTS

Figure 1:
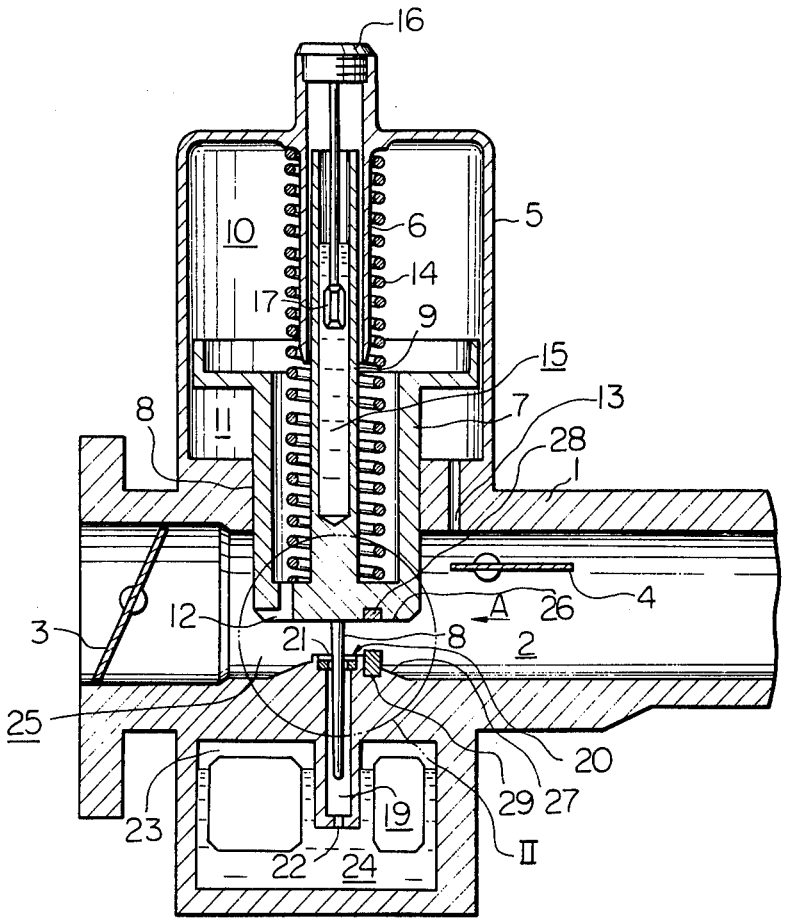
FIG. 1 is a cross-sectional view of a variable venturi type carburetor of an internal combustion engine according to the present invention.

Referring to FIG. 1, 1 designates a carburetor body, 2 an intake passage formed in the carburetor body 1, 3 a throttle valve and 4 a choke valve. The introduced air flows in the intake passage 2 in the direction shown by the arrow A. Reference numeral 5 designates an outer casing which has a hollow cylindrical guide 6 extending downwards in the central portion of the inside of the outer casing 5. Reference numeral 7 designates a suction piston which is slidably inserted into a guide hole 8 formed in the carburetor body 1 and is guided by the guide hole 8. In addition, the suction piston 7 has a suction piston rod 9 extending upwards. This suction piston rod 9 is slidably inserted into the hollow cylindrical guide 6 and is guided by the guide 6. A vacuum chamber 10 and an atmospheric pressure chamber 11, which are separated by the suction piston 7, are formed in the outer casing 5. The vacuum chamber 10 is connected to the intake passage 2 downstream of the venturi portion 25 via a suction hole 12; thus, a vacuum is produced in the vacuum chamber 10. On the other hand, the atmospheric pressure chamber 11 is connected to the intake passage 2 upstream of the venturi portion 25 via an air hole 13; thus, the pressure in the atmospheric pressure chamber 11 is maintained at approximately atmospheric pressure. A compression spring 14 is disposed between the suction piston 7 and the outer casing 5. The suction piston 7 is always biased downwards due to the spring force of the compression spring 14. The inside of the suction piston rod 9 is filled with oil 15, and a damper 17 fixed to an oil cap nut 16 is dipped in the oil 15. A needle 18 extending downwards is rigidly fixed onto the lower end of the suction piston 7 and has a cross-sectional area which gradually decreases downwards. A fuel storing chamber 19 filled with fuel is formed in the carburetor body 1. A fuel injecting jet 20 opening into the intake passage 2 is formed in the upper end of the fuel storing chamber 19. When the needle 18 moves up and down, the annular opening area 21 formed between the needle 18 and the jet 20 is accordingly changed. In addition, the fuel storing chamber 19 is connected to fuel 24 contained in a float chamber 23 via a connecting hole 22 formed on the lower end of the fuel storing chamber 19.

The variable venturi type carburetor of this invention has at least one first member 28, made of magnetic material, attached to the bottom end face 26 of the suction member 7, and; at least one second member 29, made of magnetic material, attached on the inner wall 27 of the venturi 25 at the position corresponding to the position of the first member 28. The first and second members 28 and 29 magnetically contact each other when the suction piston 7 is in the position in which the cross-sectional area of the venturi 25 is minimum. That is to say, on the bottom end face 26 of the suction piston 7 a permanent magnet 28 and on the inner wall 27 of the venturi portion of intake passage 2 a stopper made of magnetic metal material are attached, respectively. The permanent magnet 28 is mounted on the suction piston 7 in such the manner that the bottom end thereof does not project from the bottom end face 26 of the suction piston 7 or is at the same level as the latter. The stopper 29 is, however, projected a small distance from the inner wall 27 of the venturi.

The operation of the variable venturi type carburetor will be now described. As is known to those skilled in the art, the suction piston 7 moves up and down due to the difference between the pressure in the atmospheric pressure chamber 11 and the vacuum in the vacuum chamber 10, and the cross-sectional area of the venturi portion 25 is varied so that the velocity of air flowing in the venturi portion 25 is maintained at a constant value. Since the velocity of air flowing in the venturi portion 25 is always maintained at a constant value independent of an amount of air flowing in the venturi portion 25, a vacuum of a constant level, for example $\phi$mmAq, is always produced in the venturi portion 25.

Consequently, the amount of fuel, which is proportional to the cross-sectional area of an annular opening 21 formed between the needle 18 and the fuel injection jet 20, is injected into the venturi portion 25 of the intake passage 2 through said annular opening 21 from the fuel storing chamber 19. This fuel injection is due to the difference in pressure between the vacuum in the venturi portion 25 and the vacuum in the fuel storing chamber 19 (the pressure in this fuel storing chamber 19 is maintained at about atmospheric pressure, since the chamber 19 is communicated with the float chamber 23).

In a conventional variable venturi type carburetor, however, the vacuum level in the venturi portion 25 is not always maintained exactly at a constant value, as mentioned hereinbefore and consequently, a sufficient vacuum level cannot be obtained during the no-load running operation or idle driving condition. Contrary to this, in the present invention, a sufficient vacuum level can be obtained even in such a condition.

Figure 2:
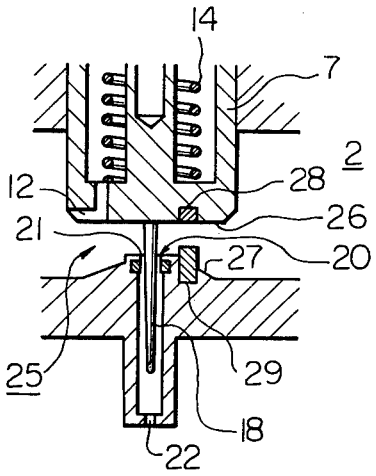
FIGS. 2 and 3 are cross-sectional views of the portion indicated by reference II in FIG. 1, FIG. 2 showing the state of the carburetor during the middle or heavy-load running operation of the engine and FIG. 3 showing the state of the carburetor during the no-load or idle running operation of the engine.
Figure 3:
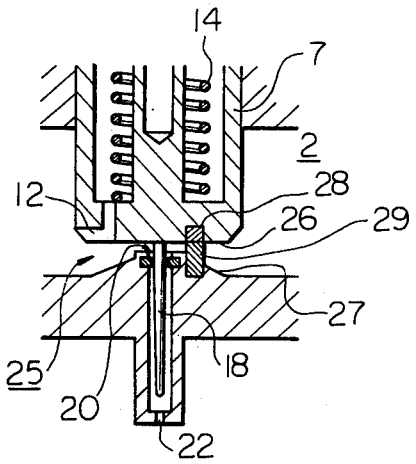

When the cross-sectional area of the venturi portion 25 is relatively large, that is during the middle or heavy load driving condition, as shown in FIG. 2, the variable venturi type carburetor of this invention operates in the same manner as a conventional carburetor. However, when the cross-sectional area of the venturi portion 25 becomes relatively small, that is when the engine gets near to the no-load running operation or idle driving condition, the permanent magnet 28 of the suction piston 7 comes into contact with the stopper 29 of the inner wall 27 of the venturi, as shown in FIG. 3, due to magnetic attractive force. At this time, the cross-sectional area of the venturi portion 25 is smaller than that of a conventional variable venturi type carburetor, because the suction piston 7 is forced downwardly due to both the spring force of compression spring 14 and the attractive force of permanent magnet 28. Therefore, the venturi vacuum level and the velocity of air flowing in the venturi portion 25 increase, so that the fuel atomization is improved on fine grains of the liquid fuel are obtained. When the amount of fuel to be fed into the engine increases from such the no-load or idle driving condition and at the time when the venturi vacuum force subjected on the suction piston 7 becomes larger than both the spring force of compression spring 14 and the attractive force of permanent magnet 28, the permanent magnet 28 fixed to the suction piston 7 leaves the stopper 29 and, thus, the suction piston 7 is allowed to move upwardly. The suction piston 7 operates in the same manner as that of a conventional variable venturi type carburetor after it moves upwardly to the position at which the attractive force between the permanent magnet 28 and the stopper 29 is not effective. The position is determined by the suitable selection of the magnetic attractive force of the permanent magnet 28, the mounting position of the stopper 29 and the like.

Another effect of the present invention is that the suction piston 7 is prevented from vibrating because of the vibration of the engine. This is because, during the no-load or idle driving condition, the suction piston 7 is compulsory maintained at the position at which the permanent magnet 28 contacts the stopper, that is to say, the position at which the cross-sectional area of the venturi portion 25 is minimum.

Therefore, the variation of the amount of fuel being fed into the engine during the no-load or idle driving condition is considerably reduced.

As mentioned hereinbefore, according to the present invention, during the no-load or idle driving condition, the characteristic of fuel atomization is improved and the variation of the amount of fuel being fed into the engine is reduced, so that the stability of fuel combustion in the engine is improved. That is to say, the stable and smooth engine revolution can be accomplished as well as a thin air-fuel mixture can be obtained during the no-load or idle driving condition. Additionally, the rate of fuel consumption is low and always constant during the no-load or idle driving condition, so that noxious combustible substances, such as HC or CO, contained in the exhaust gas are reduced.

In the specific embodiment described above, the permanent magnet 28 is fixed to the suction piston 7 and the stopper member 29 is fixed to the inner wall 27 of the venturi portion. It should be understood, however, that the permanent magnet and the stopper member can be fixed to the inner wall of the venturi portion and the suction piston, respectively. It should also be understood that both of the members 28 and 29 may be permanent magnets. It should further be understood that the stopper member 29 can be mounted on the inner wall 27 of the venturi by means of screws so that the lowest position of the suction piston or the minimum cross-sectional area of the venturi portion can be adjusted. It is also possible to make one of the two members contacting each other due to the magnetic attractive force not from a rigid member, but from resilient material such as like a rubber, so that they will smoothly contact with and leave from each other.

What is claimed is:

1. A variable venturi type carburetor of an internal combustion engine, comprising:

a housing;

a bore extending through said housing and having an inner wall defining an intake passage;

a suction piston movable mounted in said housing and having a bottom end face projecting into said intake passage, said bottom end face of said suction piston and said inner wall of said intake passage defining a venturi, said suction piston moving up and down so as to change the cross-sectional area of said venturi in response to a change in the vacuum produced in said intake passage downstream of said venturi for maintaining the velocity of air flowing into said venturi at a constant value;

a jet disposed on the inner wall of said intake passage at a position facing said bottom end face of said suction piston;

a needle fixed onto said bottom end face of said suction piston and entering into said jet, said jet and said needle defining an annular opening through which fuel is injected into said intake passage;

a fuel reservoir in said housing;

a fuel supply passage disposed in said housing and communicating said fuel reservoir with said jet;

at least one first member made of magnetic material attached to the bottom end face of said suction piston; and at least one second member made of magnetic material attached to said inner wall of said venturi at the positions corresponding to the positions of said at least one first member, said first and second members magnetically contacting each other when said suction piston is in the position in which the cross-sectional area of said venturi is minimum.

2. A variable venturi type carburetor as set forth in claim 1, wherein one of the first and second members is a permanent magnet.

3. A variable venturi type carburetor as set forth in claim 1, wherein at least one of said first and second members is made of resilient material.

4. A variable venturi type carburetor as set forth in claim 1, wherein at least one of said first and second members is attached on the bottom end face of the suction piston or the inner wall of the intake passage by thread engagement so that the minimum cross-sectional area of the venturi can be adjusted.

* * * * *

UNITED STATES PATENT AND TRADEMARK OFFICE

CERTIFICATE OF CORRECTION

PATENT NO. : 4,119,685

DATED : October 10, 1978

INVENTOR(S) : Takaaki ITOH et al

It is certified that error appears in the above-identified patent and that said Letters Patent are hereby corrected as shown below:

Please insert the name of the additional Assignee as listed below:

--AISAN INDUSTRY CO., LTD., Japan--

Signed and Sealed this

*Sixth* Day of *February 1979*

[SEAL]

*Attest:*

RUTH C. MASON
*Attesting Officer*

DONALD W. BANNER
*Commissioner of Patents and Trademarks*